US011047083B2

(12) United States Patent
Marone

(10) Patent No.: US 11,047,083 B2
(45) Date of Patent: Jun. 29, 2021

(54) LIQUID DISPENSING DEVICE, PARTICULARLY FOR DISPENSING WASHING AGENTS IN A WASHING MACHINE

(71) Applicant: ELBI INTERNATIONAL S.p.A., Turin (IT)

(72) Inventor: Giuseppe Marone, Nichelino (IT)

(73) Assignee: ELBI INTERNATIONAL S.p.A., Turin (IT)

( * ) Notice: Subject to any disclaimer, the term of this patent is extended or adjusted under 35 U.S.C. 154(b) by 70 days.

(21) Appl. No.: 16/489,567

(22) PCT Filed: Mar. 5, 2018

(86) PCT No.: PCT/IB2018/051382
§ 371 (c)(1),
(2) Date: Aug. 28, 2019

(87) PCT Pub. No.: WO2018/163039
PCT Pub. Date: Sep. 13, 2018

(65) Prior Publication Data

US 2020/0011000 A1 Jan. 9, 2020

(30) Foreign Application Priority Data

Mar. 7, 2017 (IT) ..... 102017000025159

(51) Int. Cl.
*D06F 39/02* (2006.01)

(52) U.S. Cl.
CPC ..... *D06F 39/022* (2013.01)

(58) Field of Classification Search
CPC ..... D06F 39/022; A47L 15/4418
See application file for complete search history.

(56) References Cited

U.S. PATENT DOCUMENTS 4,284,262 A * 8/1981 Ruyak ..... F16K 31/088 251/129.03
8,032,953 B2 * 10/2011 Wilson ..... E03D 9/037 4/227.1

(Continued)

FOREIGN PATENT DOCUMENTS

EP 0423044 A1 * 4/1991 ..... D06F 39/022
EP 0605903 A1 * 7/1994 ..... F04B 17/046

(Continued)

OTHER PUBLICATIONS

International Search Report for PCT/IB2018/051382 dated Jun. 12, 2018 [PCT/ISA/210].

(Continued)

*Primary Examiner* — Michael E Barr
*Assistant Examiner* — Pallavi Chitta
(74) *Attorney, Agent, or Firm* — Sughrue Mion, PLLC

(57) ABSTRACT

A dispensing device for a liquid, including a reservoir inside which a holding chamber for a liquid is defined; a ram movable inside the holding chamber, wherein between the ram and the seat a variable volume working chamber is defined, able to communicate with the holding chamber; and a non-return valve, arranged at the outlet opening and downstream of the seat. During the stroke of the ram from a forward end-of-stroke position to a backward end-of-stroke position the liquid flows from the holding chamber to the working chamber, and during the stroke of the ram from the backward end-of-stroke position to the forward end-of-stroke position the liquid is dispensed out from the working chamber through an outlet opening. The device further includes an actuating group arranged outside of the holding chamber and capable of contactlessly controlling motion of the ram.

10 Claims, 5 Drawing Sheets

(56) References Cited

U.S. PATENT DOCUMENTS

| | | | | |
|---|---|---|---|---|
| 8,136,705 | B2 * | 3/2012 | Tracy | F04B 9/00 222/333 |
| 8,424,720 | B2 * | 4/2013 | Tracy | F04B 9/00 222/1 |
| 2008/0173705 | A1 | 7/2008 | Girard et al. | |
| 2011/0174021 | A1 | 7/2011 | Lee et al. | |

FOREIGN PATENT DOCUMENTS

| | | | |
|---|---|---|---|
| WO | 2005/116499 | A1 | 12/2005 |
| WO | 2012/152609 | A1 | 11/2012 |

OTHER PUBLICATIONS

Written Opinion for PCT/IB2018/051382 dated Jun. 12, 2018 [PCT/ISA/237].

* cited by examiner

LIQUID DISPENSING DEVICE, PARTICULARLY FOR DISPENSING WASHING AGENTS IN A WASHING MACHINE

CROSS REFERENCE TO RELATED APPLICATIONS

This application is a National Stage of International Application No. PCT/IB2018/051382 filed Mar. 5, 2018, claiming priority based on Italian Patent Application No. 102017000025159 filed Mar. 7, 2017.

The present invention relates in general to liquid dispensing devices, for example dispensing devices for washing agents such as detergents or rinsing agents in washing machines, such as dishwashers or washing machines.

In particular, the present invention relates to a dispensing device for a liquid, comprising A reservoir within which a holding chamber for a liquid is defined, said chamber being capable of communicating with the outside of the reservoir through an outlet opening for liquid dispensing;

a ram movable within the holding chamber and capable of assuming a forward end-of-stroke position, in which the ram engages a seat formed at the outlet opening and blocking fluid communication between the holding chamber and the outside of the holding chamber, and a backward end-of-stroke position in which the ram is removed from the seat, wherein a variable volume working chamber capable of communicating with the holding chamber is defined between the ram and the seat; and non-return valve means arranged at the outlet opening and downstream of the seat, said non-return valve means being open or closed when difference between fluid pressure upstream thereof and fluid pressure downstream thereof is higher or lower than a predetermined value, respectively;

wherein during the stroke of the ram from the forward end-of-stroke position to the backward end-of-stroke position the liquid flows from the holding chamber to the working chamber, and during the stroke of the ram from the backward end-of-stroke position to the forward end-of-stroke position the liquid is compressed within the working chamber and, upon opening of the non-return valve means, is dispensed out from the working chamber through the outlet opening;

wherein the device further comprises actuating means arranged at the outside of the reservoir and capable of contactlessly controlling motion of the ram.

In the dispenser according to the invention it is not necessary to provide openings in the reservoir walls to allow mechanical elements to operate on the ram. Technical problems related to the construction of hydraulic sealing systems are therefore avoided, and therefore the configuration of the reservoir is significantly simplified.

In some embodiments, it is also advantageous to have the valve means and/or the ram disposed removably inside the reservoir, for example positioned in a removable cap.

In this way, the problems of washability of the entire volume and of the entire surfaces that come into contact with detergents are overcome. A characteristic of liquid detergents which is not very functional at automatic dosages is in fact that after a certain time of exposure to the air or in use, they tend to change their viscosity until they reach the solid state. In this case, having an object completely washable in the parts that come into contact with the detergent, and having an easily accessible inner volume solves the problems for the restoration of the functions.

Further features and advantages of the invention will become apparent from the detailed description that follows, provided purely by way of non-limiting example with reference to the accompanying drawings, in which.

I

Figure 1:
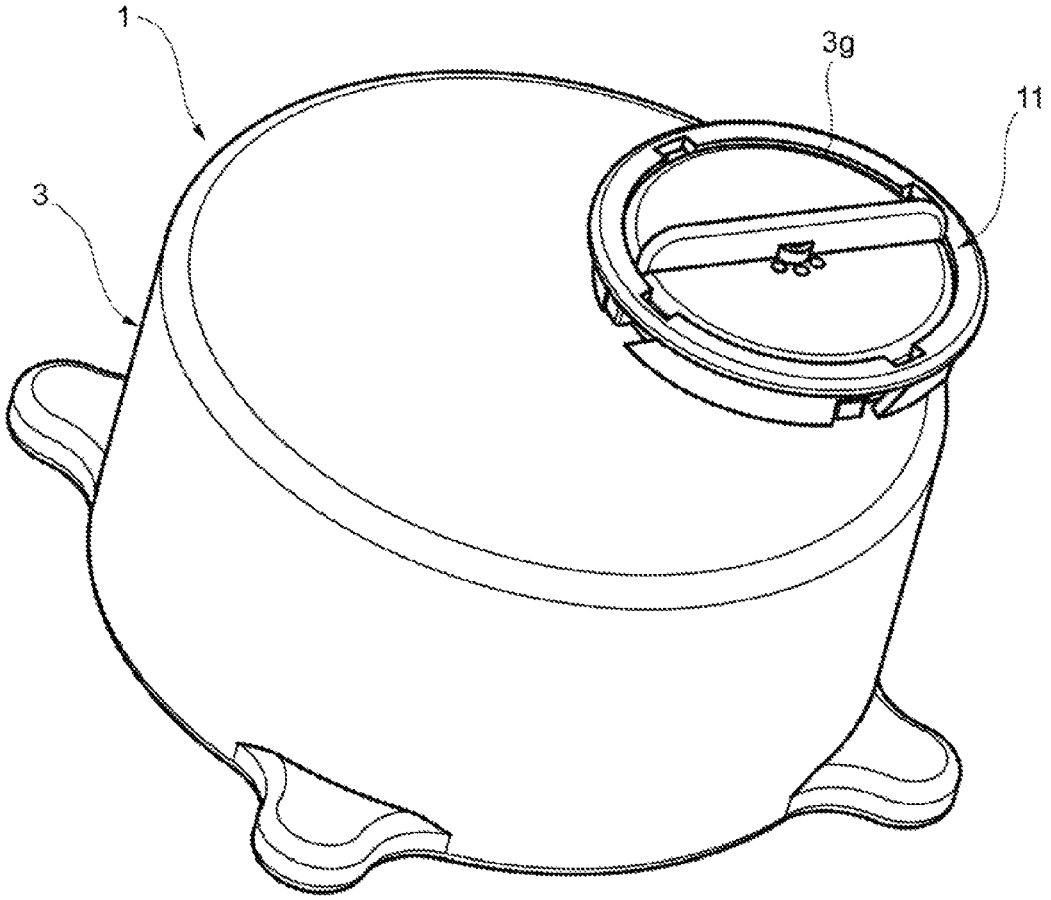
FIG. 1 is a perspective view of a dispensing device according to the invention.
Figure 4:
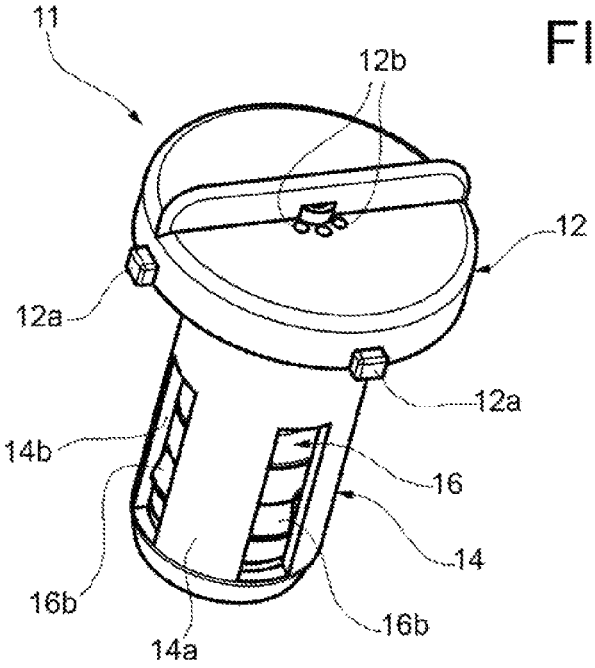
FIGS. 4 and 5 are perspective views of some components of the dispensing device.
Figure 5:
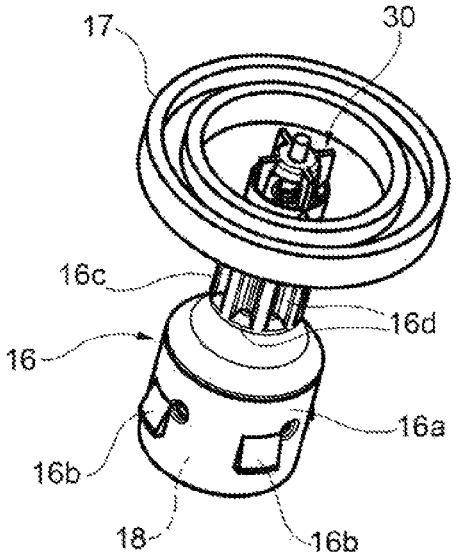

With reference to FIGS. 1 to 5, a dispensing device for liquids is shown, indicated as a whole with reference numeral 1. The device 1 can, for example, be a device for dispensing a washing agent such as a detergent or a rinse agent in a washing machine, such as a dishwasher or a washing machine.

The device 1 essentially comprises a reservoir 3, inside which a holding chamber 3*d* is obtained for storing the liquid, and a cap 11 mounted on the reservoir 3. The reservoir 3 can be a plastic element consisting of two parts coupled to each other, for example by means of thermal welding processes, but it can also be made in a single part, for example by means of blowing processes.

The cap 11 is sealably mounted at a filling mouth 3*g* of the reservoir 3. The cap 11 comprises a head 12 and a hollow shank 14 which extends axially from the head 12, inside the holding chamber 3*d*. A seal 15 is arranged on the side of the cap 11 facing the shank 14 and is adapted to be compressed between the head 12 of the cap 11 and a wall of the reservoir 3 around the mouth 3*g*, when the cap is mounted on the reservoir. Through the head 12 of the cap, a plurality of openings or through outlet holes 12*b* are formed. The closure of the cap can be screw or bayonet, as in the illustrated example, by means of radial projections 12*a* formed on the perimeter of the cap head 12 which engage corresponding grooves formed on the perimeter of the filling mouth 3*g* of the reservoir 3.

The shank 14 comprises a radially outer tubular wall 14*a*, on which a pair of longitudinally opposed longitudinal slits 14*b* is formed, and a radially inner tubular wall 14*c*, coaxial with the radially outer tubular wall 14*a* and having a smaller longitudinal extension than it. The cavity inside the radially inner tubular wall 14*c* is in communication with the outlet openings 12*b* formed on the head 12 of the cap 11.

The end of the shank 14 away from the cap head 12 is inserted in a centering collar 3*h* formed in the bottom of the reservoir 3.

Inside the shank 14, a ram 16 is guidably mounted. The ram 16 comprises a guide part 16*a*, slidably inserted inside the radially outer tubular wall 14*a* of the shank 14 and provided with guide protrusions 16*b* inserted in the slits 14*b*, and a ram end portion 16*c* provided with longitudinal grooves 16*d* on the lateral surface thereof. At the top of the ram end portion 16*c* is a membrane 17 of deformable material, e.g. elastomeric material. The membrane 17 is fixed to the ram end portion 16*c* at the centre thereof, while it is free to bend peripherally.

At a forward end-of-stroke position of the ram 16, the ram end portion 16*c* is designed to abut against a seat 14*d* formed on the inner side of the radially inner tubular wall 14*c*. The seat 14*d* is positioned at a predetermined distance from the free end of the radially inner tubular wall 14*c*. Between the seat 14*d* and the free end of the radially inner tubular wall 14*c*, a chamber 14*e* is thus defined surrounded by a continuous wall, that is to say, without lateral openings.

A permanent magnet 18 is fixed to the ram 16, positioned in such a way as to have a polarity oriented parallel to the direction of movement of the ram 16.

The permanent magnet 18 is designed to contactlessly interact with a pair of permanent control magnets 21, 22 arranged outside the reservoir 3, on the other side of the bottom wall thereof. However, other means are possible to contactlessly control the ram 16, in particular means based on electromagnets able to create static or variable electromagnetic fields. However, other means for contactlessly controlling the ram 16 are possible, in particular means based on electromagnets capable of generating static or variable magnetic fields.

The control magnets 21, 22 are arranged in such a way as to have a polarity oriented parallel to the direction of movement of the ram 16. One of them, 21, hereinafter referred to as the retraction magnet, points a pole towards the magnet 18 opposite the pole which the magnet 18 points towards the magnet 21. The other, 22, hereinafter referred to as the advancing magnet, points a pole towards the magnet 18 of sign identical to that of the pole which the magnet 18 points towards the magnet 22.

The control magnets 21, 22 are supported by a movable support member 23, for example rotating about an axis y parallel to the direction of movement of the ram 16. With respect to such a support member 23, the magnets 21 and 22 occupy angularly distinct positions, in particular diametrically opposite positions. However, this arrangement is not mandatory, as a configuration in which the magnets can be moved alternately is also contemplated.

The support member 23 is mounted on a support structure (not shown), integral with the reservoir 3 or independent of it, and receives motion from an actuator 24, for example a rotary actuator or a linear actuator.

A unidirectional non-return valve device 30 is positioned at the head 12 of the cap. This device 30 is positioned in the cavity delimited by the radially inner lateral wall 14*c*, between the seat 14*d* and the outlet openings 12*b*. The non-return valve device 30 is conventionally provided with elastic means which urge the shutter in a closed position. The valve device 30 is therefore configured to be open or closed when the difference between a fluid pressure upstream thereof (i.e. in the chamber 14*e*) and a fluid pressure downstream thereof (i.e. at the outlet openings 12*b*) is respectively greater than or less than a predetermined value (determined in substance by the elastic means).

Figure 2:
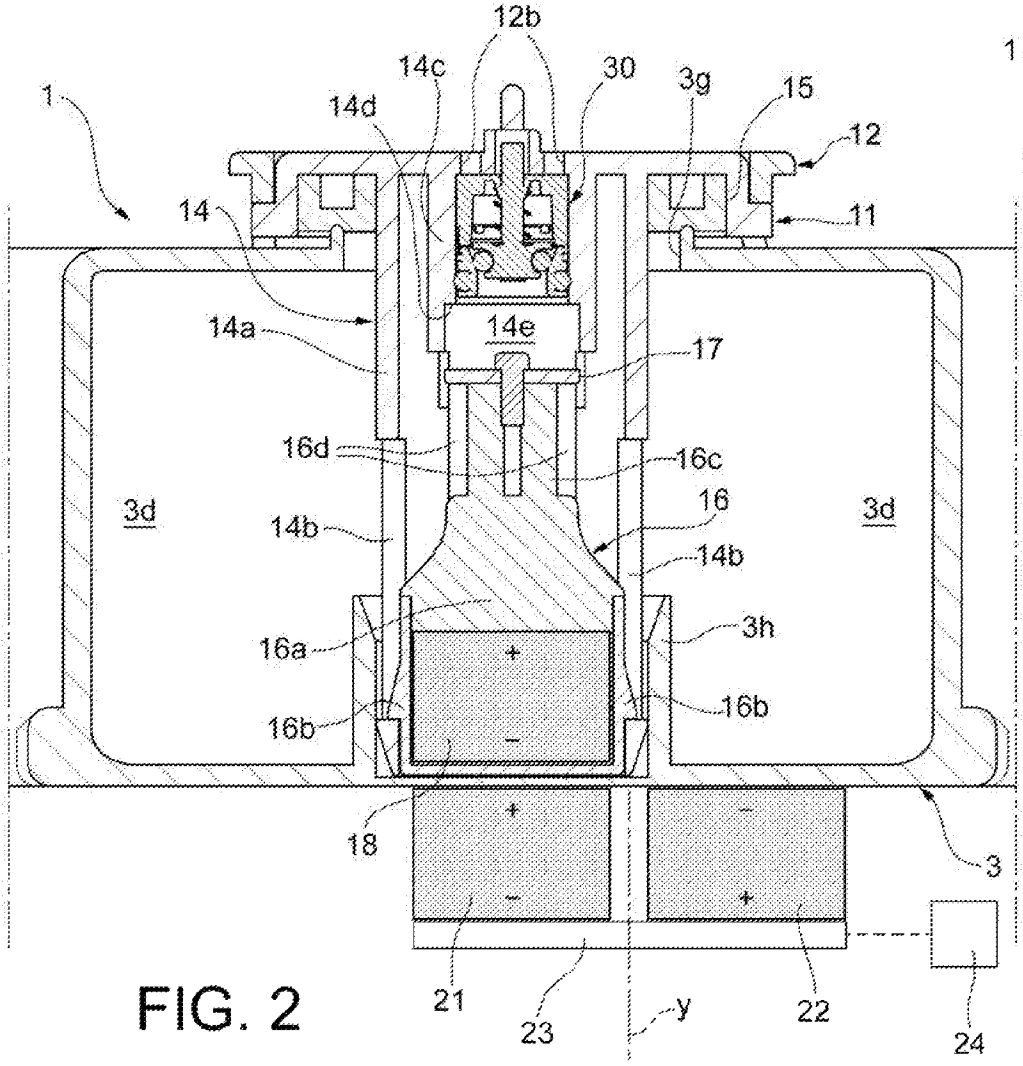
Figure 7:
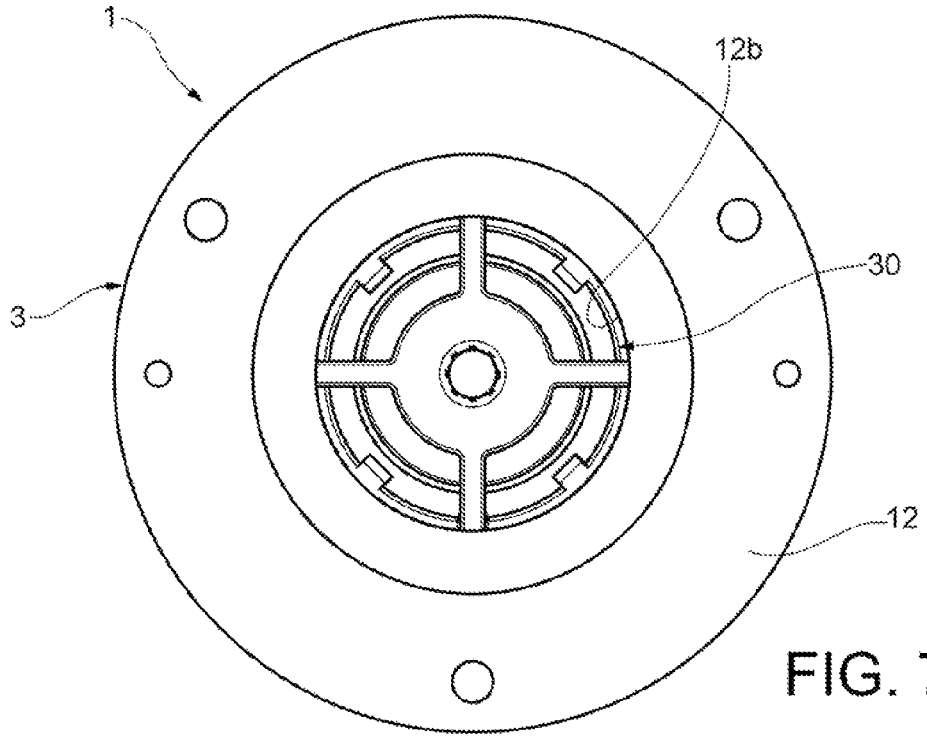
FIGS. 6 and 7 are side elevation and plan views, respectively, of a dispensing device according to a further embodiment.
Figure 6:
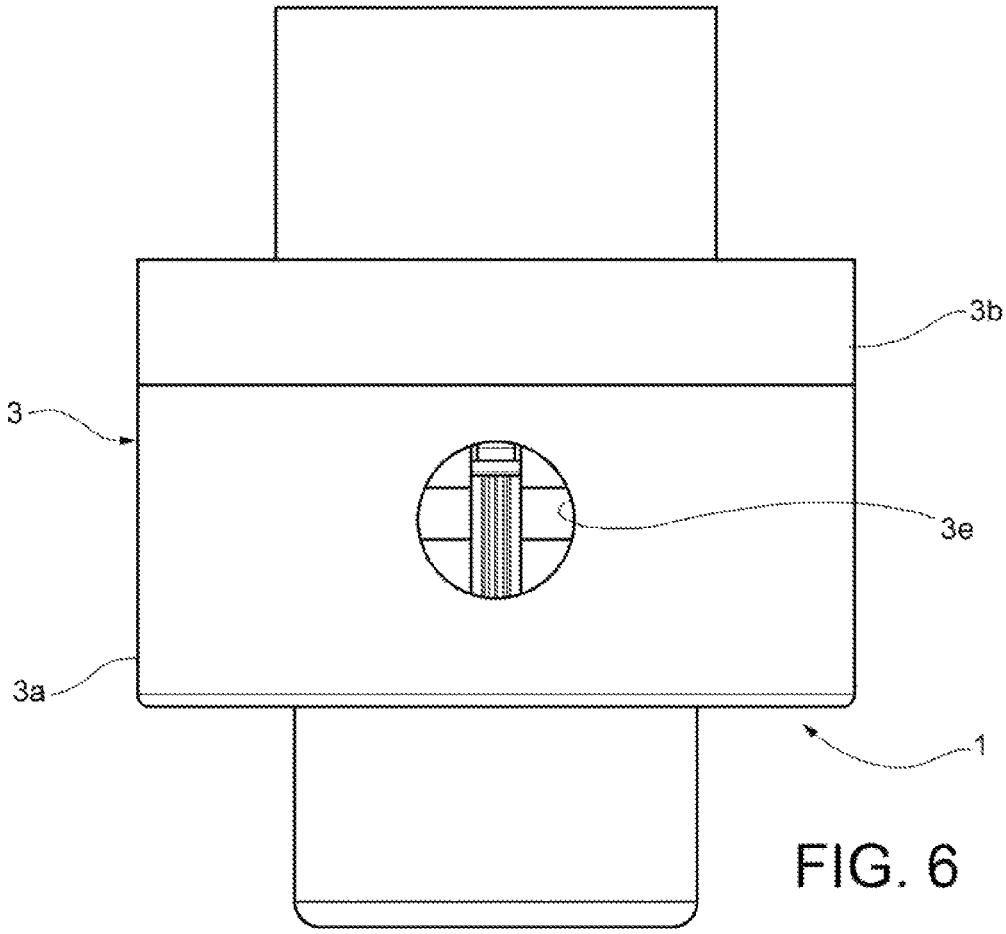
Figure 8:
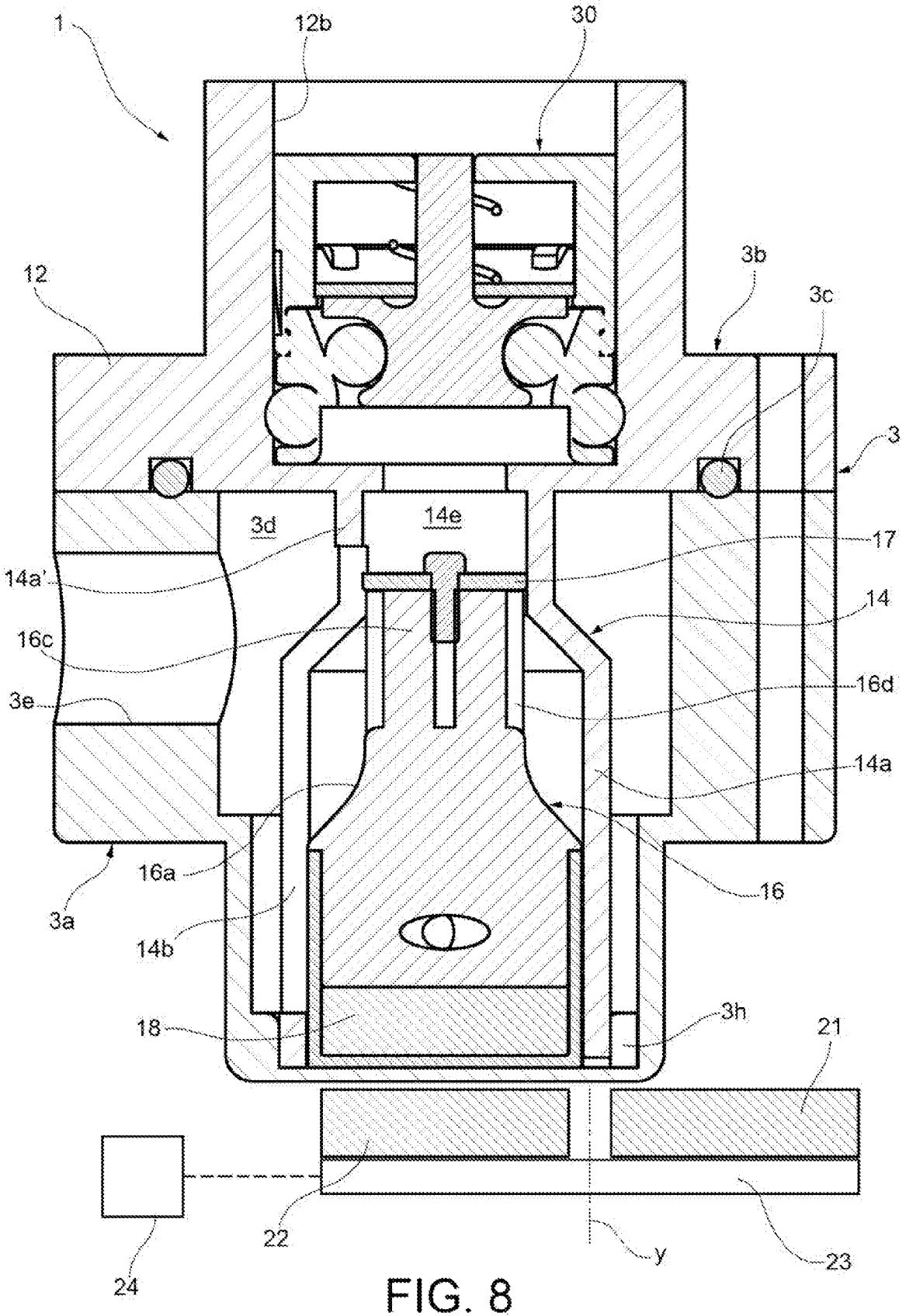
FIGS. 8 and 9 are schematic and sectional views of the device in FIGS. 6 and 7, in two different operating positions.

In the retracted end position shown in FIG. 2, the ram 16 is substantially resting against the bottom wall of the reservoir 3, and is held in this position due to the magnetic attraction between the magnet 18 of the ram 16 and the retraction magnet 21 which are positioned opposite each other.

Figure 3:
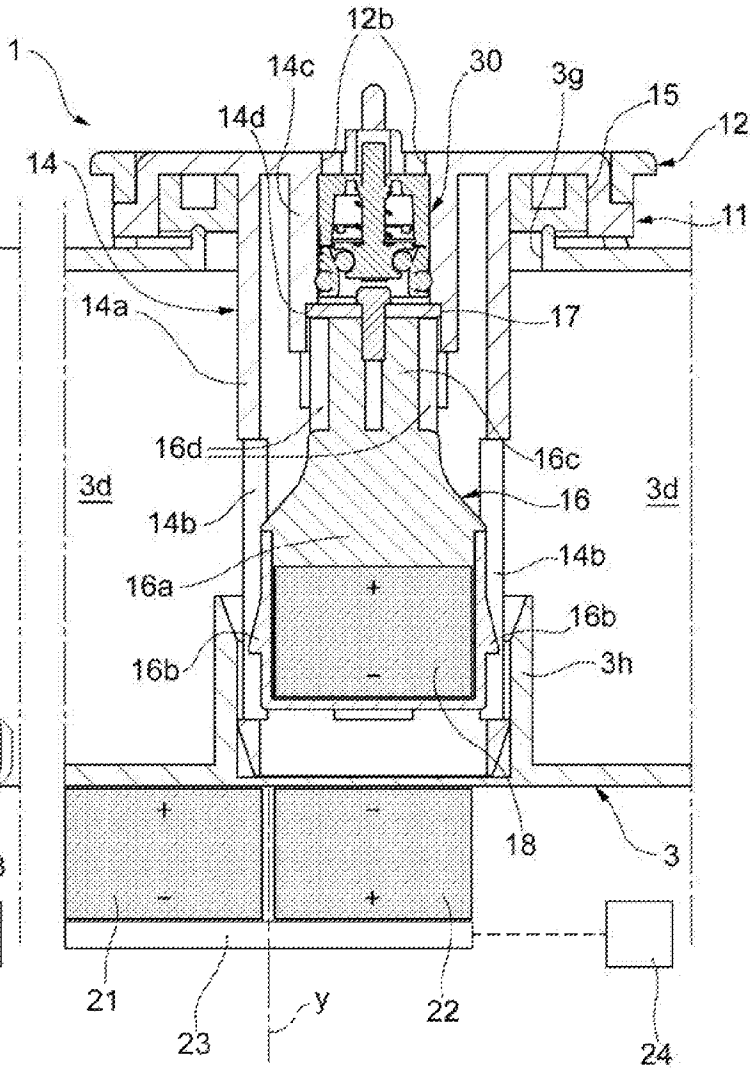
FIGS. 2 and 3 are schematic and sectional views of the device, in two different operating positions.

As a result of a control signal sent by a control unit to the actuator which controls the support member 23, the actuator controls the rotation of the support member 23 so as to bring the advancing magnet 22 in front of the magnet 18 of the ram 16 (FIG. 3).

Due to the magnetic repulsion between the magnet 18 of the ram 16 and the advancing magnet 22, the ram 16 advances towards the seat 14*d* with the membrane 17. When the membrane 17 begins to engage the free end of the radially inner tubular wall 14*c*, the compression of the liquid inside the chamber 14*e* causes the opening of the non-return valve device 30 and therefore the delivery of the liquid, for example dispensing a detergent into the washing chamber of a dishwashing machine. The movement of the ram ends when the membrane 17 reaches the seat 14*d*. At the end of the ram advancement, the non-return valve 30 is closed, determined by its elastic means. Overall, a volume of liquid is therefore delivered substantially equal to the maximum volume of the chamber 14*e* upstream of the seat 14*d* (determined by the distance between the seat 14*d* and the free end of the radially inner tubular wall 14*c*).

As a result of another control signal sent by the actuator which controls the support member 23, the actuator controls the rotation of the support member 23 so as to bring the retraction magnet 21 in front of the magnet 18 of the ram 16 (FIG. 2).

Due to the magnetic attraction between the magnet 18 of the ram 16 and the retracting magnet 21, the ram 16 withdraws with the membrane 17 towards the retracted end position. The closure of the non-return valve device 30, which occurred at the end of the ram advancement step, prevents liquids outside the reservoir from entering the reservoir 3. For example, in the case of a dishwashing machine, the water circulating in the washing chamber C of the machine is prevented from entering the reservoir 3; at the same time, the ram is prevented from suctioning the detergent pushed forward by the previous movement into the reservoir. At the beginning of the retraction movement, the membrane 17 bends peripherally as a result of contact with the radially inner tubular wall 14*c* and/or the thrust of the liquid in the grooves 16*d* on the ram end portion 16*c*, allowing the liquid present in the holding chamber 3*d* to reach the chamber 14*e* adjacent to seat 14*d*. The membrane 17 returns to its non-deformed configuration when the ram 16 is retracted by such an extent as to bring the membrane 17 out of the chamber 14*e* adjacent to the seat 14*d*. The movement of the ram 16 ends when the bottom wall of the reservoir is reached. To prevent the ram from hitting the bottom wall of the reservoir in a noisy manner, a damping chamber 3*m* (delimited at the top by a dashed line in FIG. 3) is provided at the bottom of the reservoir, inside which the liquid opposes a resistance to the retraction of the ram. This is ensured by a lateral wall around the damping chamber 3*m* (in this case provided by one end of the shank), in which calibrated passages (not visible in FIG. 3) are obtained which allow the liquid in the damping chamber 3*m*, compressed by the ram 16 during the backward movement of the latter, to exit into the holding chamber 3*d* of the reservoir.

With the retraction of the ram, a new quantity of liquid is loaded into the chamber 14 ready to be delivered in a subsequent movement.

In the case of a dishwashing machine, generally the volume of detergent needed for a machine cycle can reach 40/50 $cm^3$, then the movement of the ram which delivers only a small part of the volume at each cycle (for example 2/3 $cm^3$) must be repeated in a series of pulses until the expected quantity is reached.

Although advantageous for the washability of the reservoir, the configuration in which the ram and the valve device are positioned inside the removable cap is not mandatory. For example, it is possible to conceive an embodiment in which such components are partially or completely positioned outside the cap. Being in this case the function of supporting the components provided by parts obtained in the body of the reservoir, the cap would only maintain the closing function.

With reference to FIGS. 6 to 9, a further embodiment of the invention is now illustrated. The same reference numbers have been assigned to elements corresponding or equivalent to those already described in the above embodiment.

In the device in FIGS. 6 to 9, the body of the reservoir 3 is formed by two distinct parts 3*a* and 3*b*, which will be indicated below as base and cover. The base 3*a* and the cover 3*b* are removably fixed together, for example by screws. Between the parts 3*a* and 3*b* of the reservoir, a seal 3*c* is interposed.

In base 3*e*, a duct 3*e* is formed for loading the liquid into the holding chamber 3*d*. In a manual loading embodiment, the duct 3*e* can be closed with a removable cap. In an automated loading embodiment, the duct 3*e* can be provided to be connected to a supply system.

The cover 3*b* comprises a head 12 and a hollow shank 14 which extends axially from the head 12, inside the holding chamber 3*d*. Through the cap head 12 there is formed a through outlet hole or opening 12*b*.

The shank 14 comprises a tubular wall 14*a*, on which a slit or opening 14*b* is formed which puts the interior of the shank 14 in communication with the rest of the holding chamber 3*d*. The slit 14*b* extends in such a way as to leave a portion 14*a*' of the tubular wall 14*a*, closer to the outlet opening 12*b*, free of lateral openings, that is, in other words, which continuously surrounds the cavity inside the tubular wall 14*a*. The cavity inside the tubular wall 14*a* is in communication with the outlet opening 12*b* formed on the head 12 of the cover 3*b*.

The end of the shank 14 away from the cover head 3*b* is inserted in a centering seat 3*h* formed in the bottom of the reservoir 3.

Inside the shank 14, the ram 16 is guidably mounted. At a forward end-of-stroke position of the ram 16, the ram end portion 16*c* is designed to abut against a seat 14*d* formed on the inner side of the tubular wall 14*a*. The seat 14*d* is positioned at a predetermined distance from the free end of the radially inner tubular wall 14*c*. Between the seat 14*d* and the end of the continuous portion of tubular wall 14*a*', a chamber 14*e* is thus defined.

A unidirectional non-return valve device 30 is positioned at the head 12 of the cover. This device 30 is positioned between the seat 14*d* and the outlet opening 12*b*.

Figure 9:
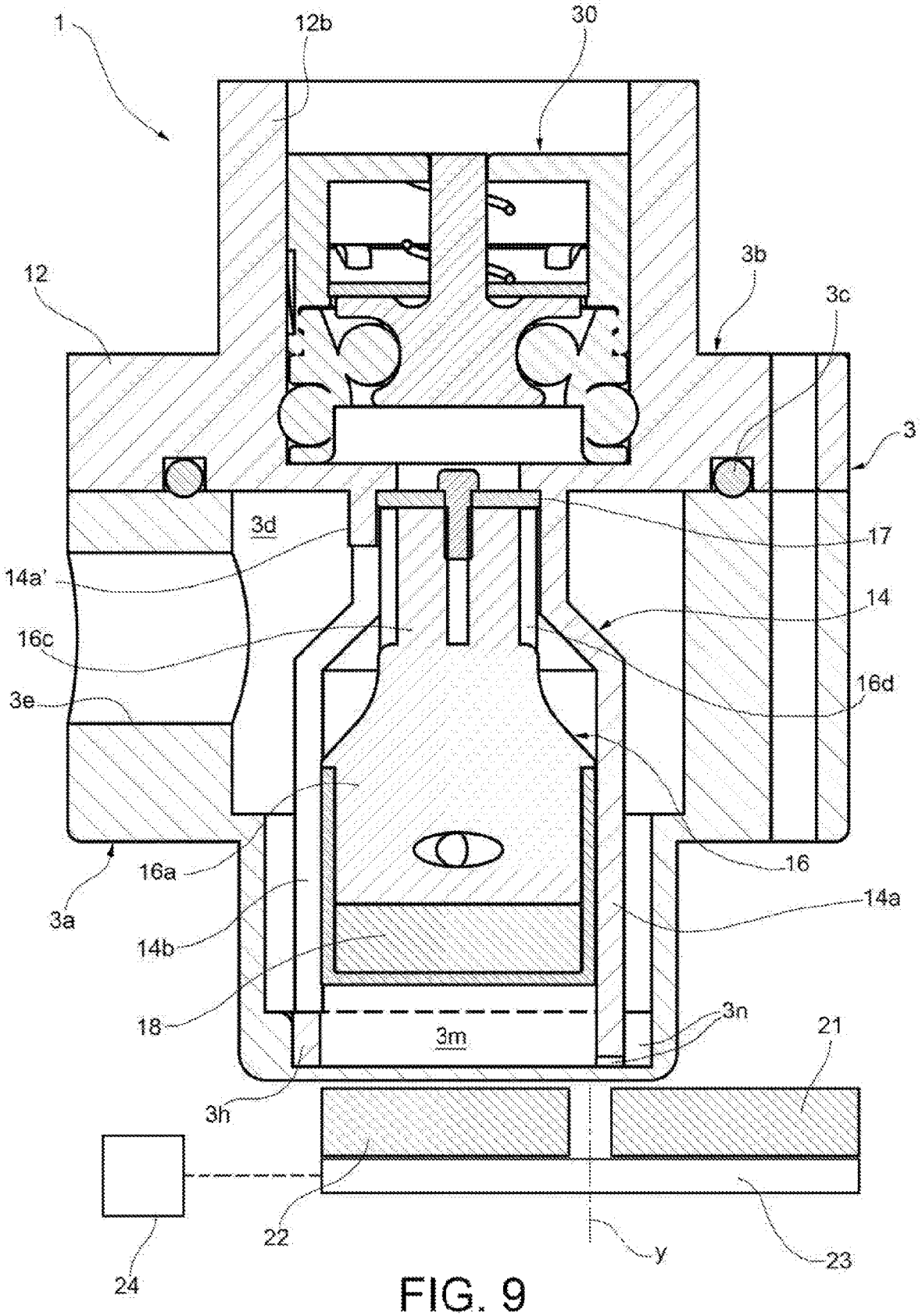

FIG. 9 also shows the damping chamber 3*m* (in this case provided by one end of the shank), in which a calibrated passage 3*n* is formed, which allows the liquid in the damping chamber 3*m*, compressed by the ram 16 during the backward movement of the latter, to exit into the holding chamber 3*d* of the reservoir.

For the remainder, the structure and operation of the device in FIGS. 6 to 9 are substantially corresponding to those of the device in FIGS. 1 to 5.

Of course, without altering the principle of the invention, the embodiments and the construction details may vary widely with respect to those described and illustrated purely by way of non-limiting example, without thereby departing from the scope of the invention as defined in the appended claims.

The invention claimed is:

1. A liquid dispensing device comprising at least one reservoir within which a holding chamber for a liquid is defined, said holding chamber being capable of communicating with the outside of the reservoir through an outlet opening for liquid dispensing;

a ram movable within the holding chamber and capable of assuming a forward end-of-stroke position, in which the ram engages a seat formed at the outlet opening and blocking fluid communication between the holding chamber and a region outside the outlet opening, and a backward end-of-stroke position in which the ram is removed from the seat, wherein a variable volume working chamber capable of communicating with the holding chamber is defined between the ram and the seat; and a non-return valve arranged at the outlet opening and downstream of the seat, said non-return valve being open or closed when difference between fluid pressure upstream thereof and fluid pressure downstream thereof is higher or lower than a predetermined value, respectively;

wherein during the stroke of the ram from the forward end-of-stroke position to the backward end-of-stroke position the liquid flows from the holding chamber to the working chamber, and during the stroke of the ram from the backward end-of-stroke position to the forward end-of-stroke position the liquid is pressurized within the working chamber and, upon opening of the non-return valve, is dispensed out from the working chamber through the outlet opening;

wherein said liquid dispensing device further comprises an actuating assembly arranged at the outside of the reservoir and capable of contactlessly controlling motion of the ram.

2. The device according to claim 1, wherein a permanent magnet is fixed to the ram, and wherein the actuating assembly is capable of controlling motion of the ram by inverting magnetic polarity.

3. The device according to claim 2, wherein the actuating assembly comprises a movable support carrying at least one pair of control permanent magnets spaced from each other and having opposite polarities, and an actuator provided for shifting the support and selectively presenting one of the said control permanent magnets in front of the permanent magnet.

4. The device according to claim 2, wherein the actuating assembly comprises a support rotatable about an axis and carrying the at least one pair of control permanent magnets angularly spaced from each other and having opposite polarities, and an actuator provided for rotating the support and selectively presenting one of the said control permanent magnets in front of the permanent magnet fixed to the ram.

5. The device according to claim 1, wherein the variable volume working chamber is formed surrounded by a continuous wall close to the seat wherein a membrane is fixed to an end of the ram facing towards the seat, said membrane being capable of sliding in contact with the continuous wall during a final section of the stroke of the ram from the backward end-of-stroke position to the forward end-of-stroke position, and wherein a plurality of grooves communicating with the holding chamber are formed on a lateral surface of the ram so that during an initial section of the stroke of the ram from the forward end-of-stroke position to the backward end-of-stroke position the membrane is peripherally bent toward the seat.

6. The device according to claim 1 further comprising a removable cap mounted on the reservoir, at least one of said ram and said non-return valve being positioned within the cap, wherein said actuating assembly is not present on the cap.

7. The device according to claim 6, wherein the cap comprises a head sealingly mounted at a mouth of the reservoir, through which the outlet opening for liquid dispensing is formed, and in which said non-return valve is positioned, and a hollow shank within which the ram is guidably positioned.

8. The device according to claim 1, wherein the reservoir comprises a cover part and a base part sealingly fixed to each other, wherein at least one of said ram and said non-return valve are positioned within the cover part, and wherein a loading duct for loading the liquid into the holding chamber is formed in the base part of the reservoir.

9. The device according to claim 1, comprising a damper for causing the ram to slow down during a final section of the stroke of the ram from the forward end-of-stroke position to the backward end-of-stroke position, said damper acting by pressurization of liquid at the backward end-of-stroke position.

10. The device according to claim 9, wherein said damper comprises a damping chamber formed at the backward end-of-stroke position of the ram and communicating with the holding chamber through a calibrated passage.

* * * * *